US006488055B2

(12) United States Patent
Chen

(10) Patent No.: US 6,488,055 B2
(45) Date of Patent: Dec. 3, 2002

(54) PNEUMATIC STEEL BAR BINDING MACHINE MECHANISM

(76) Inventor: Tien-I Chen, 1, Alley 15, Antou Lane, Yenping Li, Changhua City (TW), 500

( * ) Notice: Subject to any disclaimer, the term of this patent is extended or adjusted under 35 U.S.C. 154(b) by 0 days.

(21) Appl. No.: 09/749,885

(22) Filed: Dec. 29, 2000

(65) Prior Publication Data

US 2002/0083994 A1 Jul. 4, 2002

(51) Int. Cl.[7] ..... B21F 15/04
(52) U.S. Cl. ..... 140/119; 140/54
(58) Field of Search ..... 140/53, 54, 57, 140/119

(56) References Cited

U.S. PATENT DOCUMENTS 3,169,559 A * 2/1965 Working, Jr. ..... 140/119
3,494,385 A * 2/1970 Hanigan ..... 140/54
4,941,515 A * 7/1990 Vrenning ..... 140/57

* cited by examiner

*Primary Examiner*—Lowell A. Larson
(74) *Attorney, Agent, or Firm*—Harrison & Egbert

(57) ABSTRACT

A pneumatic steel bar binding machine mechanism to bind two or more column-shaped steel bars together, or specifically, a machine to bind the steel frames inside the concrete framework in construction works, characterized in a pneumatic mechanism and a spiral twister that press steel staples in the shape of reversed-U onto the steel bars to be bound, before the spiral twister is driven to twist the two ends of the steel staple into a twisted rope, to secure the steel bars.

4 Claims, 11 Drawing Sheets

PNEUMATIC STEEL BAR BINDING MACHINE MECHANISM

FIELD OF THE INVENTION

The invention relates to a pneumatic steel bar binding machine mechanism to bind two or more column-shaped steel bars together, particularly the steel framework contained inside concrete structures in construction works, the components in a main unit 10 include an air valve chamber 30, a cylinder chamber 50, a pneumatic motor 70, a steel staple 20, a staple cartridge 40 and a spiral twister 80 and a J-mechanism 60.

[Prior Art]

Conventionally, the steel bars regularly used in the construction of concrete structures are fastened by tying iron wires directly around them with hands and/or pliers. Such a binding process can be sophisticated and troublesome, as well as time and labor consuming. Slight negligence on the operator's part will result in improper binding efficiency, causing potential risks to the steel bars that may loosen. At the present, some construction workers may use an electrical steel bar binding machine. The motor in such a binding machine, however, may overheat after an extended period of use. Furthermore, direct sunshine often adds to its burden. Also, because the electrical cord of the steel bar binding machine is very long, a worn or torn electrical cord may result in leak of electrical conductance and cause danger in its operation. Besides, the steel bar binding machine itself is quite heavy, its binding speed is slow and inefficient, which can cause increased working costs.

SUMMARY OF THE INVENTION

It is therefore the objective of this invention to provide a pneumatic steel bar binding machine mechanism with high efficiency, low labor strength, and safe operation, which will quickly and automatically push out a steel staple tightly against the steel bars, to enable firmer binding point, and since the pressing force and binding force are automated, its binding efficiency can be assured.

In accordance with the foregoing, a pneumatic steel bar binding machine is provided.

BRIEF DESCRIPTION OF DRAWINGS

The invention can be fully understood by reading the following detailed description of three preferred embodiments, with reference made to the accompanying drawings, wherein.

BRIEF DESCRIPTION OF NUMERALS

Figure 1:
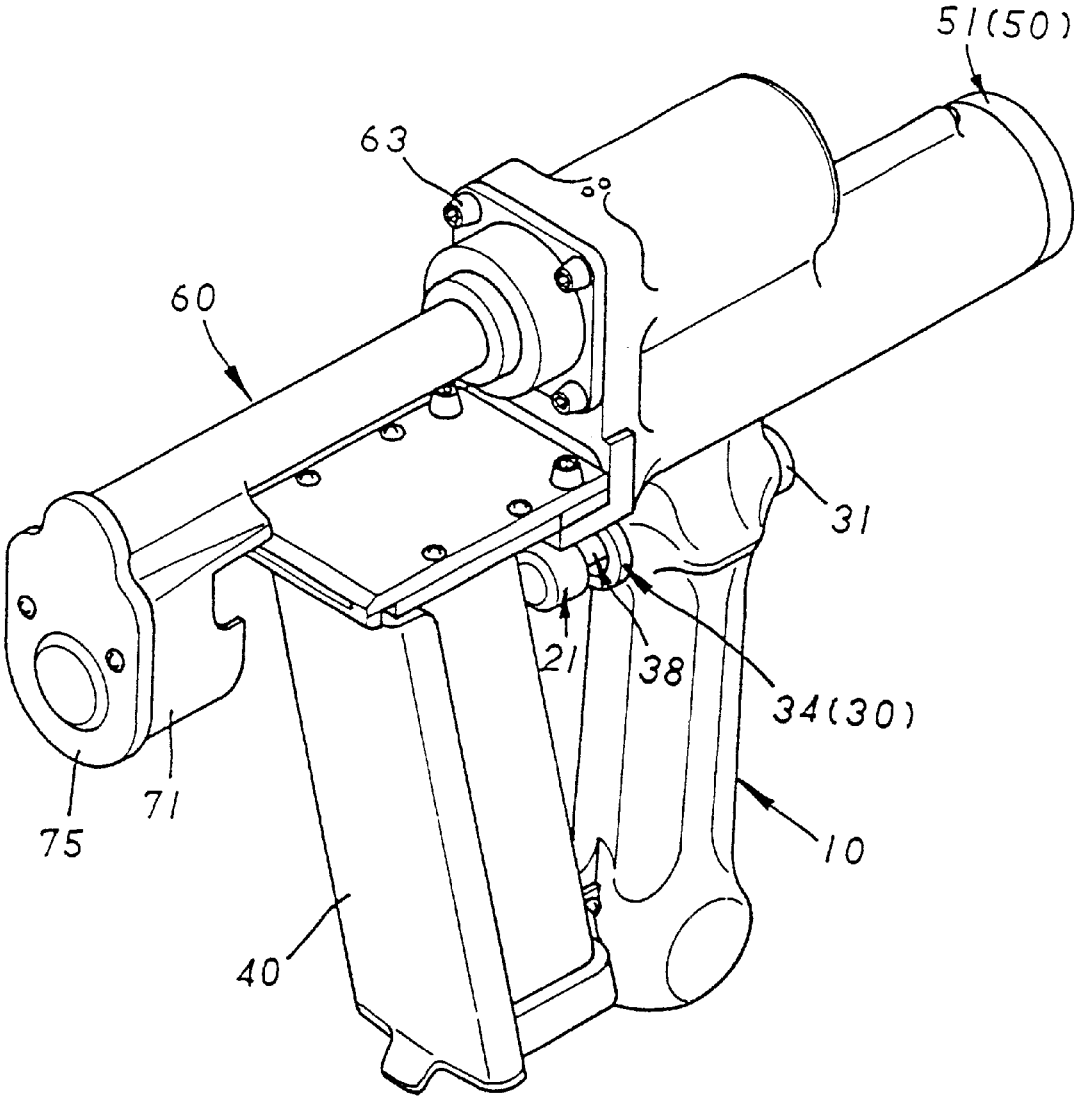
FIG. 1 is a perspective view of the invention of pneumatic steel bar binding machine.

10 main unit of pneumatic steel bar binding machine
20 steel staple
30 air valve chamber
40 staple cartridge
50 cylinder chamber
60 J-mechanism
70 pneumatic motor
80 spiral twister
90 ramming mechanism
21 trigger
22 air inlet channel
23 air input hole
24 upper oblique channel
25 air inlet
26 air outlet
27 mini air inlet
28 twisted rope
29 lower oblique channel
30 air blocking nut
33 spring
34 air valve
36 air stop rubber ring
37 accommodating hole
38 striking rod
40 staple cartridge
41 air blocking screw
42 depressed channel
45 hollow channel
46 air stop rubber ring
47 striking rod air inlet
48 striking rod air outlet
50 cylinder chamber
51 magnetic nut
52 air stop rubber ring
53 magnet
54 round iron
55 planet gear set
56 rivet
57 pressing plate
58 ramming rod
59 air blocking rubber ring g
60 J-mechanism
61 transmission shaft
62 large bearing
63 screw
64 small bearing

65 small gear
66 gear pin
67 nut
68 large gear with large hole
69 small gear overlapping large gear
70 pneumatic motor
71 support ring
72 arched and V-shaped groove
73 large gear with small hole
74 twister blade
75 speed reducing mechanism cover
76 arched groove
77 accommodating hole
78 flattened post
79 parallel arched groove
80 spiral twister
90 ramming mechanism
60' J-mechanism
601' connecting block
602' accommodating hole
603' placement hole
61' transmission shaft
64' small bearing
65' small gear
66' gear shaft
661' small bearing
662' small bearing
67' nut
68' idler
681' gear pin
69' small gear
71' support ring
73' large hole large gear
75' speed reducing mechanism cover
77' accommodating hole
79' parallel arch groove
80' spiral twister

DETAILED DESCRIPTION OF PREFERRED EMBODIMENTS

Figure 2:
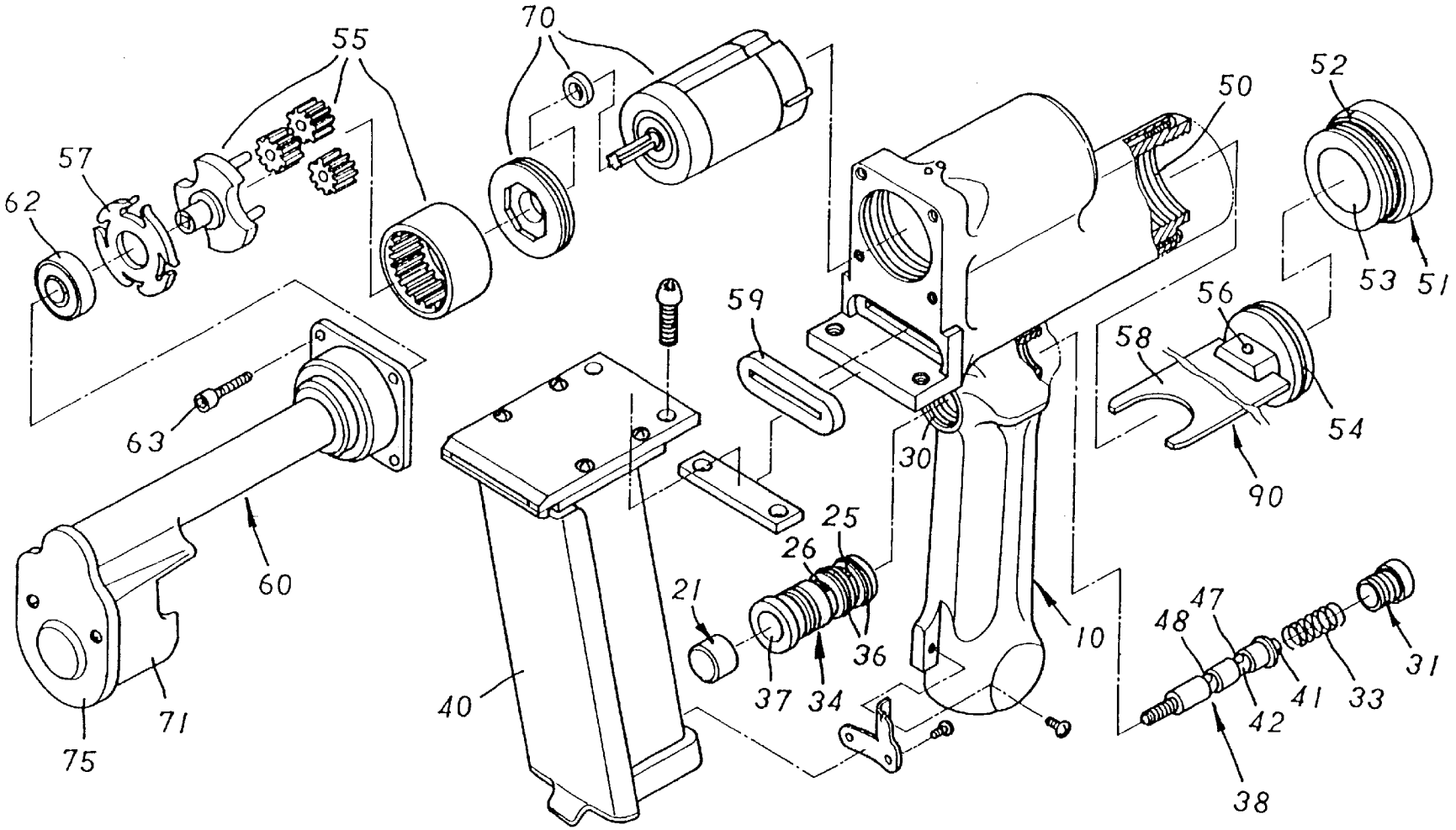
FIG. 2 is an exploded view of the invention of pneumatic steel bar binding machine before it is assembled.

Please refer to FIGS. 1 and 2, which illustrate a perspective view and an exploded view of the invention of pneumatic steel bar binding machine. The binding machine is composed mainly of a main unit and a J-mechanism, the main unit comprising:

The air valve 34: two air stop rubber rings 36 are inserted in the middle section on its surface with a groove in its middle section, at the middle section of the groove is a transverse air inlet 25, at its lower section is also a groove at which middle section is a transverse air outlet 26, at the center of its upper end is a round hole, penetrating to the center of its lower end, to form an accommodating hole 37, the area around the surface of the accommodating hole 37 is larger than the area of the round hole, to be inserted by the striking rod 38, so that it can slide up and down, to control the flow of air, (this is a three-section air valve).

The striking rod 38: at the center of its upper surface is drilled a round hole, extending to its lower section is a transverse penetrating air outlet 48, forming a hollow air channel 45, on the upper section of said;hollow air channel 45 is a tapping thread, to tighten the air blocking screw 41, the middle section of the striking rod 38 has a recess to form a channel 42, to allow air to flow through an upward and oblique channel 24 to a cylinder chamber 50, at the middle section of said recessed channel 42 is a transverse and penetrated air inlet 47, to allow air to flow through this air inlet 47 to the air outlet 48 to the lower oblique channel 29 to the cylinder chamber 50.

The air blocking nut 31: screwed tight at the top of the air valve chamber 30, at the center of its bottom surface is installed a spring 33, to facilitate up and down movement of the striking rod.

The parts inside the cylinder chamber 50 include a magnetic nut 51, an elongated square air blocking rubber 59 and a ramming mechanism 90, in which:

The cylinder chamber 50: at its bottom is a gutter, on the outside surface at the bottom of the cylinder chamber 50 is installed an elongated square air blocking rubber ring 59, at the center of the elongated square air blocking rubber ring 59 is a gutter to facilitate extension of the ramming rod 58 out of the cylinder chamber 50.

The magnetic nut 51: tightened at the top of the cylinder chamber 50, at its bottom is a magnet 53 to suck a round iron 54. at the top of the ramming mechanism 90, to reset the ramming mechanism 90 to its correct position.

The ramming mechanism 90: at its top is a round iron 54, at the center of the lower surface of the round iron 54 is inserted a ramming rod 58, the end of the ramming rod 58 is inserted in the gutter at the bottom of the cylinder chamber 50. The bottom end of the ramming rod 58 is processed in the shape of a reverses-U groove, around the groove is drilled a semi-circle guide groove, so designed that when the ramming rod 58 is to ram on the steel staple, the steel staple can be set in position.

The pneumatic motor 70: similar to a regular pneumatic motor, the only difference is that on one side of a cylinder chamber 50 is drilled a mini air inlet 27, and the end section of the core column of the pneumatic motor 70 is machined to become a small gear and a planet gear 55 that are toothed as a set of speed reducing unit.

Figure 6:
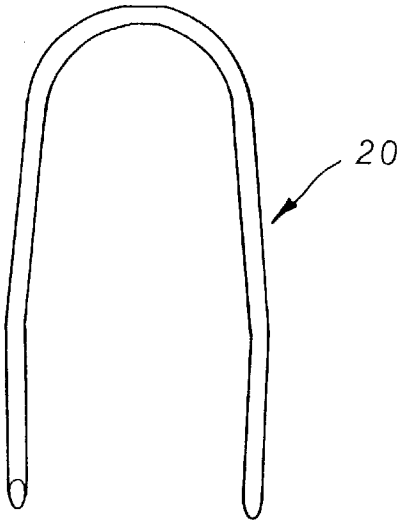
FIG. 6 is a perspective view of the steel staple of the invention of pneumatic steel bar binding machine.

The steel staple: made of a metal steel filament of powerful tenacity and pulling strength and machined in the shape of a reverse-U, as shown in FIG. 6, the middle section of the top of the steel staple 20 is parallel, the function of the parallel small section is to enable secondary bending when it contacts the steel bar, so the two ends can be twisted by a spiral twister 80. Two ends of the steel staple are cut in an oblique 45-degree angle with a slightly wider end of the U-shape opening, to avoid impact when the steel staple 20 is inserted in the spiral twister 80.

The staple cartridge 40: similar to a regular staple cartridge, except that the specifications of the width and height and shape of the gutter inside the staple cartridge are designed to suit the steel staple.

Figure 3:
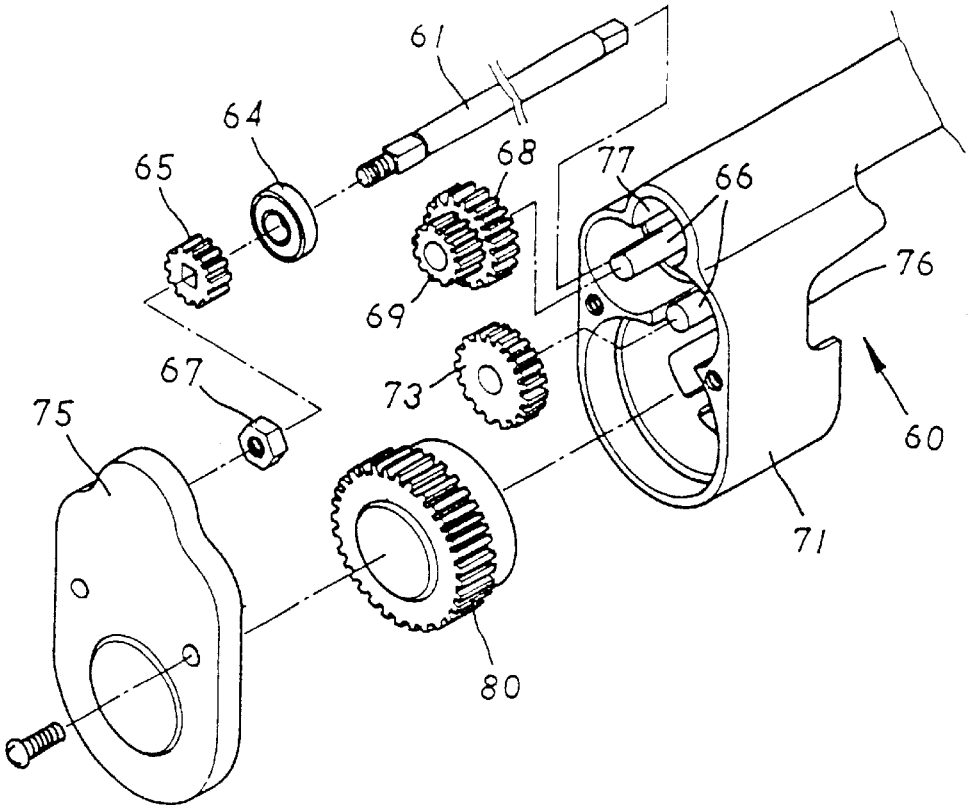
FIG. 3 is an exploded view of the invention of pneumatic steel bar binding machine before it is assembled.
Figure 4:
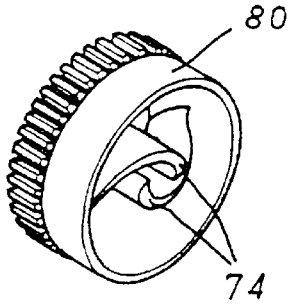
FIG. 4 is a perspective view taken from another angle of the spiral twister of the invention of pneumatic steel bar binding machine.
Figure 7:
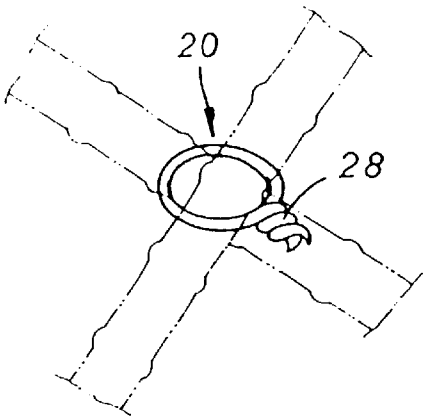
FIG. 7 illustrates how the steel staple of the invention of pneumatic steel bar binding machine has fastened two steel bars crossing each other.

As shown in FIG. 3, parts inside the J-mechanism 60 include a transmission shaft 61, a spiral twister 80, a bearing 61, a small gear 65, a large gear 68, a gear pin 66, and a support ring 71, in which:

The spiral twister 80: made of a hard and tenacious metal alloy by lost wax precision casting, the whole unit has a protrusion, at the center of its top is drilled a V-shaped hole having a wider upper section and a narrower lower section (shown in FIG. 4), in the hole is installed two arched twister cutting blades 74 with a thicker end and a thinner end, between the two twister cutting blades 74 is the formation of a round hole with a specified depth, to twist the two ends of the steel staple into a twisted rope 28 (shown in FIG. 7), at the lower section of the round hole is a flattened post 78 that serves to tighten the two twister cutting blades 74, and to control the length and tension of the twisted rope 28. The disc at its lower part is machined as a gear disc, which is toothed with the large gear 73 as one set. On the outside rim of the spiral twister 80 is installed a support ring 71, at the top of the support ring 71 are two opposing openings of arched groove 76, serving to set the steel bars to be bound in position, and, between the arc groove 76 and the arc groove 76, on the inside edge, are erected two arcs, and, the opposing V-grooves 72 serve to align the steel staple when the steel staple is inserted into the spiral twister.

Figure 5:
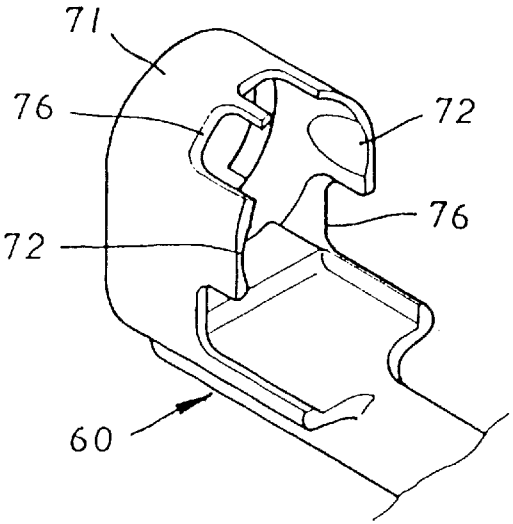
FIG. 5 illustrates the lower section of the J-mechanism in the invention of pneumatic steel bar binding machine.

The J-mechanism 60: made of tenacious and hard metal alloy by lost wax precision casting, the entire unit is a monobloc formed J-mechanism 60 (shown in FIG. 5). The top of the J-mechanism 60 is in a square shape, on the protrusions at four corners are four round holes, serving to tighten four screws linking the pneumatic motor 70, at the center of the top of the J-mechanism 60 is drilled a round hole with a larger upper part and a smaller lower part, which penetrates to the center of the bottom of its lower part, to become an accommodating hole 77, to accommodate penetration by the planet gear 55 and the transmission shaft 61, while on the upper and lower ends of the transmission column 61 are bearings for positioning purpose. The end section of the transmission shaft 61 is machined in a square shape, at the end of the square is screw thread to accommodate the small gear 65, the small gear 65 is toothed to the large gear 68, the upper part of the large gear 68 is overlapping on the small gear 69, thus by engaging the small gear 69 to the large gear 73, and the large gear 73 to the gear disc at the lower part of the spiral twister 80, the speed can be reduced, and the spiral twister will perform its twisting function and bind the steel bars.

Figure 8:
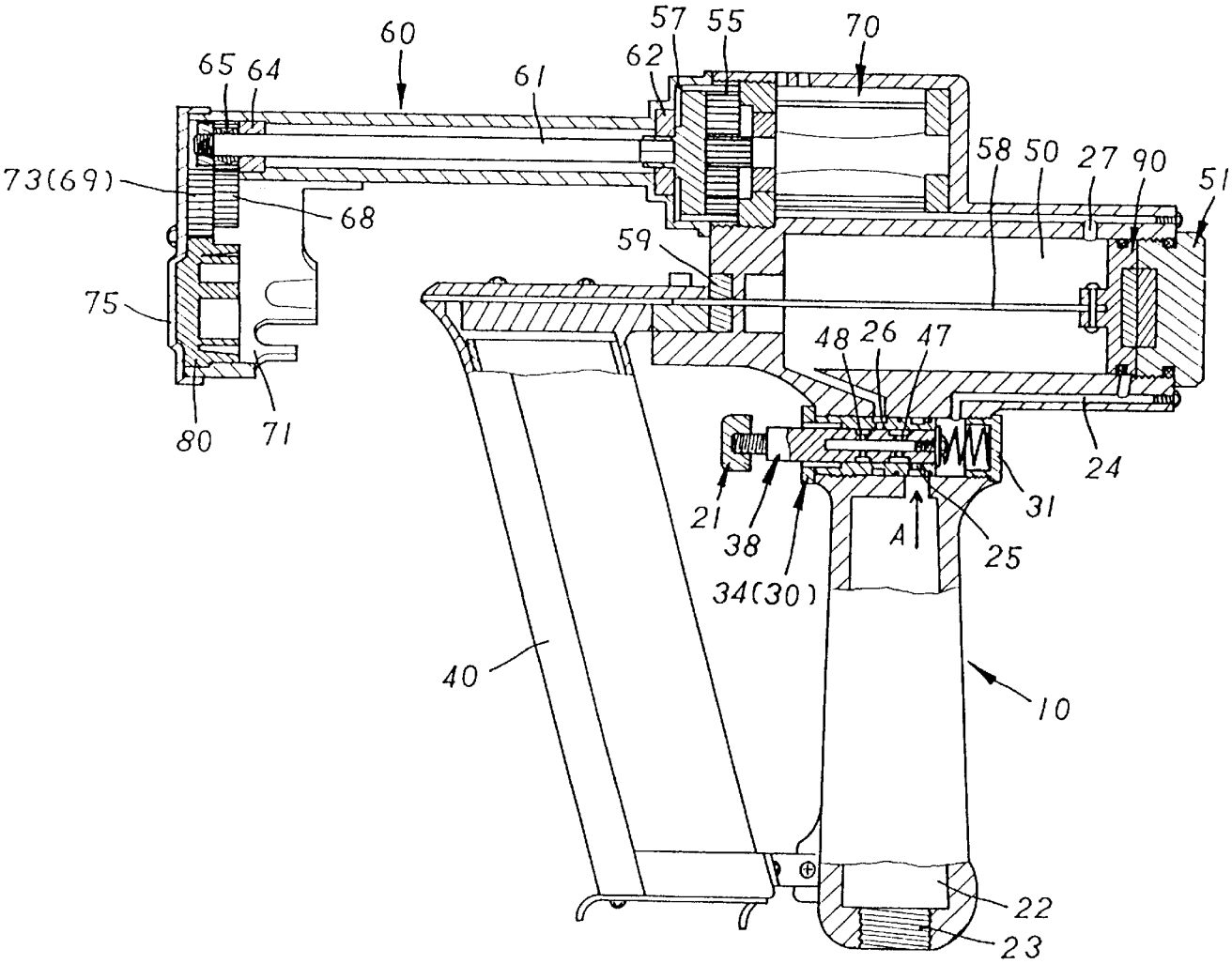
FIG. 8 is a section view of the invention of pneumatic steel bar binding machine.

Please refer to FIG. 8, which is a section view of the invention of pneumatic steel bar binding machine, this view illustrates a static condition before a press 21 is depressed, in which, air is flowed from the air inlet channel 22 simultaneously to the air hole of the air inlet 25 (airflow A) at the middle section of the air valve 34, and since the air outlet 48 of the striking rod 38 and the air inlet 25 of the air valve 34 are split, to prevent air from flowing to the upper oblique channel 24 and the lower oblique channel 29. In the static condition of the press 21 before it is depressed, the main unit of pneumatic binding machine 10 is not in use, it will simultaneously prevent the main unit of the binding machine, when not in use, air flowing into the cylinder chamber 50 and result in automatic ramming on the steel staple by the ramming mechanism 90 and result in danger.

Figure 9:
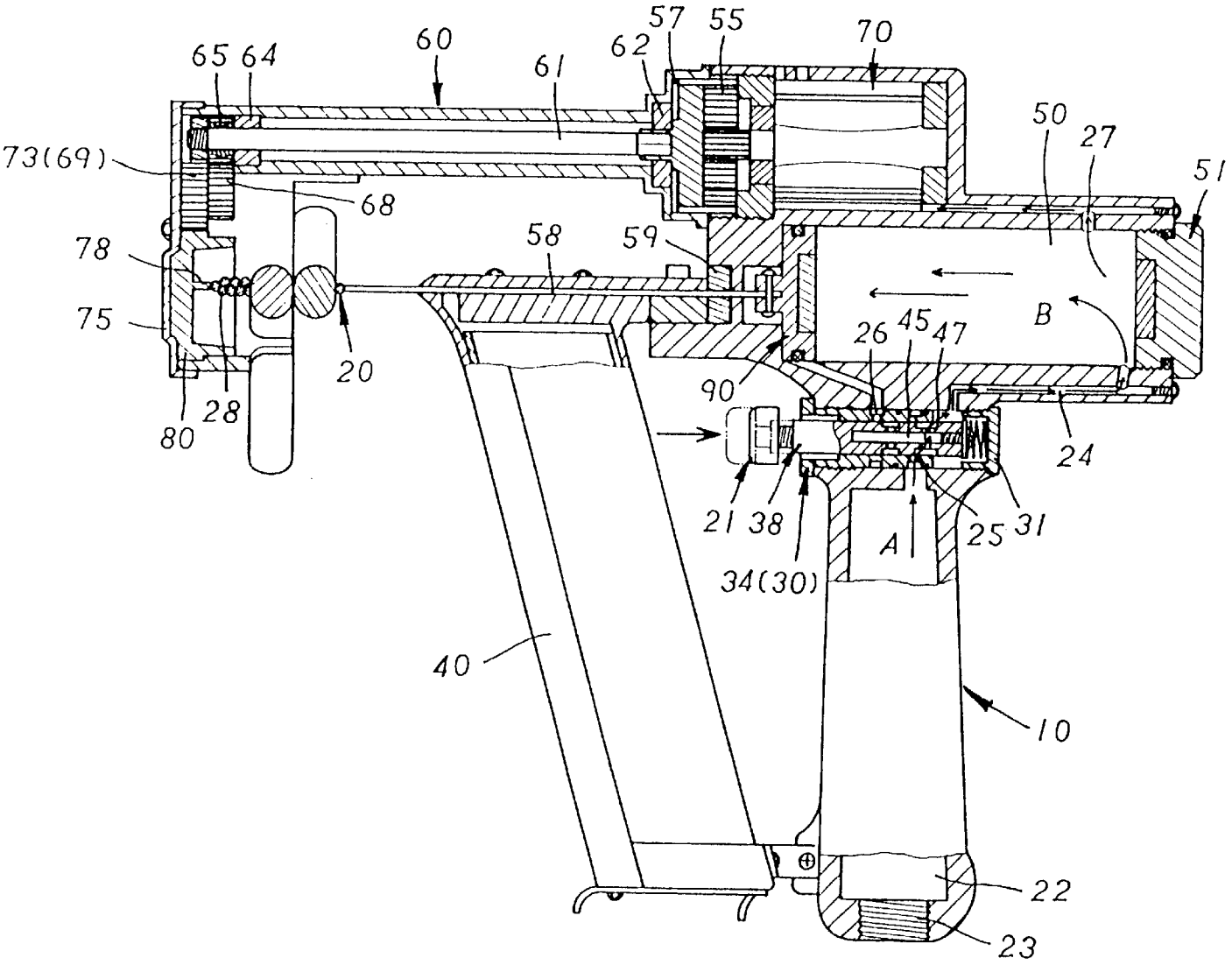
FIG. 9 illustrates how air flows in the invention of pneumatic steel bar binding machine.
Figure 10:
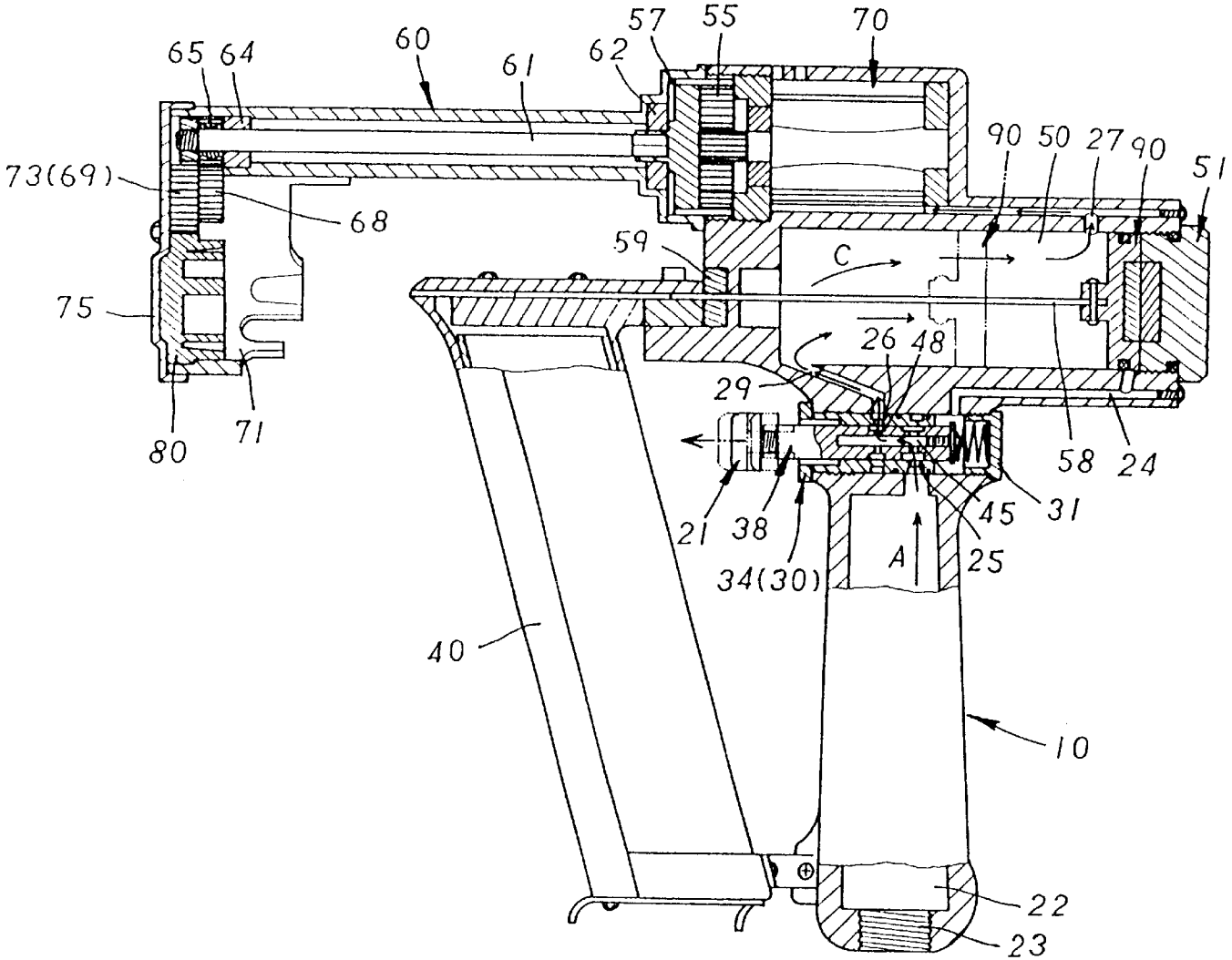
FIG. 10 illustrates how air flows in the invention of pneumatic steel bar binding machine.
Figure 11:
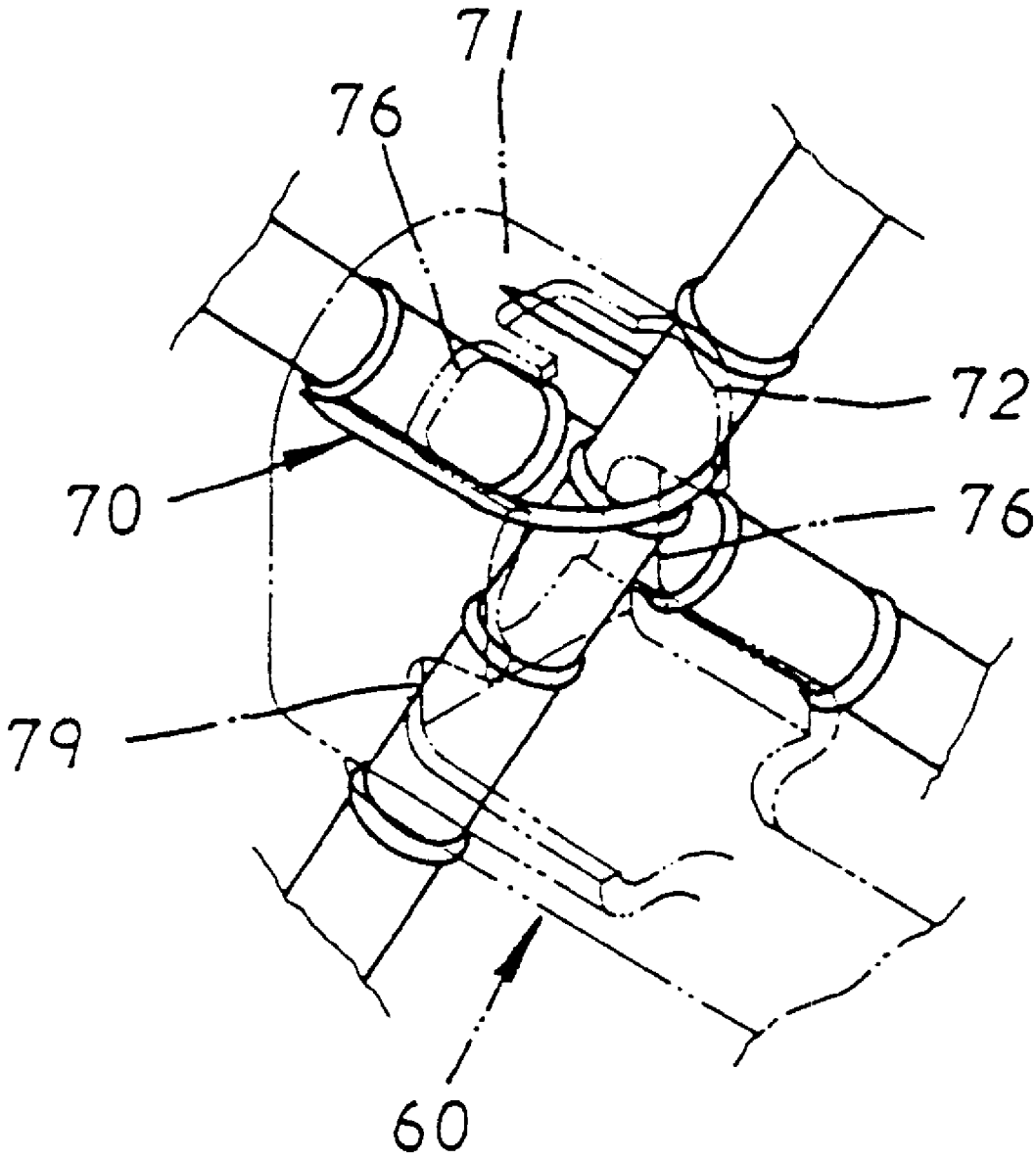
FIG. 11 illustrates how the steel staple of the invention of pneumatic steel bar binding machine has fastened two steel bars crossing each other.

Please refer to FIGS. 9 and 10, which illustrates how air flows in the invention of pneumatic steel bar binding machine, FIG. 9 shows how air flows when the binding machine has hooked onto the spot where steel bars are to be bound and the press 21 is depressed, in which, when the trigger 21 is pressed upwardly, air flows from the air inlet 25 to the depressed channel 42 of the striking rod 38 and upwardly out of the air valve 34, air flows simultaneously to the upper oblique channel 24, to the cylinder chamber 50 (airflow B), and simultaneously ram on the ramming mechanism 90, so that the ramming mechanism 90 escapes the magnet 53 and rams downwardly, so the rammer rod 58 rams the steel staple 20 to the steel bars and achieve the purpose of the rammer. Then, airflow B flows from the mini air inlet 27 of the cylinder chamber 50 into the pneumatic motor 70, the pneumatic motor 70 rotates and drives the spiral twister 80, and twist the two ends of the steel staple 20 into a twisted rope 28 (shown in FIGS. 7 and 11). As shown in FIG. 10, it illustrates how air flows when the trigger 21 is half released, when the trigger is half released, the upper outlet is closed, when the ramming mechanism 90 completes its ramming function, airflow B in the cylinder chamber 50 flows quickly from the mini air inlet 27 to the pneumatic motor 70, then there is not much air in the cylinder chamber 50, and meantime, since the trigger is half released, and the air outlet 48 of the striking rod 38 is opened, air flows instantly to the air inlet 47 of the striking rod 38 and out of the air outlet hole 26 of the air valve 34, meanwhile, airflow flows to the lower oblique channel 29, to the cylinder chamber 50 (airflow C) and rams on the ramming mechanism 90 and quickly rise, because of the powerful upward pushing force, the round iron 54 at the top of the ramming mechanism 90 rams on the magnet 53 on the magnetic nut 51 before it drops down, then, the magnetic force of the magnet 53 installed on the magnetic nut 51 will capture the round iron 54 at the top of the ramming mechanism 90, and reset to its position. When the ramming mechanism 90 has reset to its position, airflow C will be discharged from the mini air inlet hole 27.

Aforementioned airflow occurs when the trigger 21 is pressed and released intermittently, to complete reciprocation of the striking rod 38, as well as other functions such as the ramming and resetting of the ramming mechanism 90, rotation of the pneumatic motor 70 to drive the spiral twister 80, air input and air output, and the steel bar binding operation, so that the operation can be automated to upgrade quality and efficiency.

Figure 12:
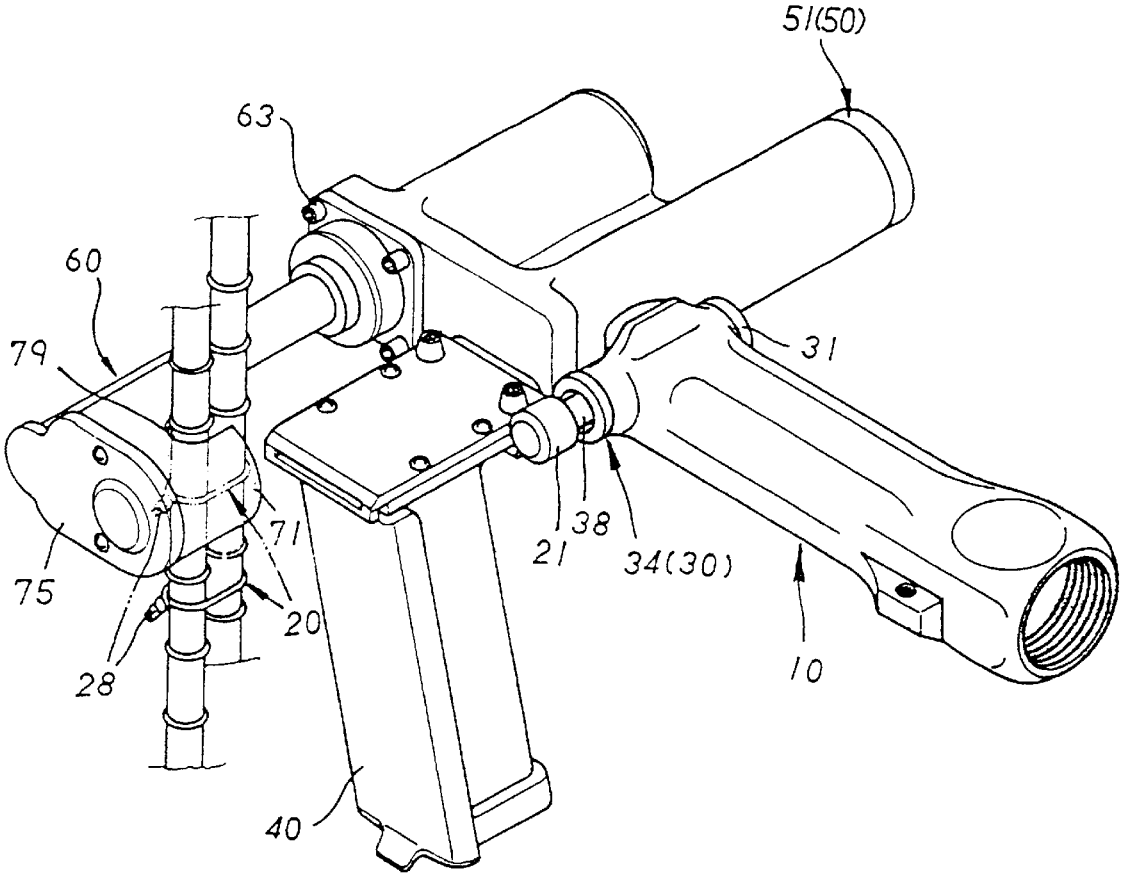
FIG. 12 illustrates another embodiment of the invention of pneumatic steel bar binding machine in the process of binding two thinner parallel steel bars.

In another embodiment of the invention described above, thinner parallel steel bars can be tied and bound. In this embodiment shown in FIG. 12, the ramming mechanism 90 and the staple cartridge 40 are positioned at the front of the cylinder chamber 50 and assembled at 90 degrees to bind thinner parallel steel bars.

Figure 13:
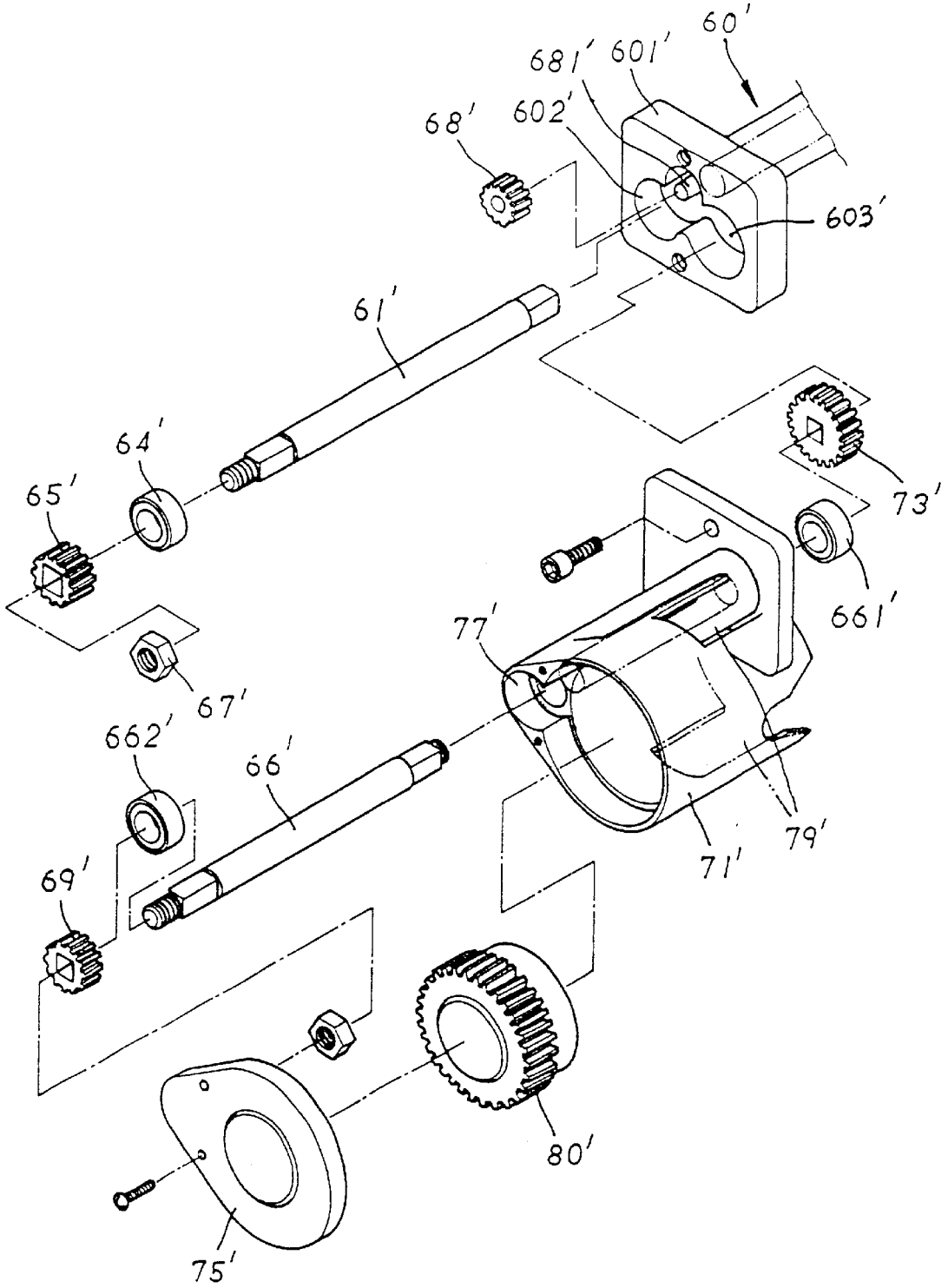
FIG. 13 is an exploded view of J-mechanism in yet another embodiment of the invention of pneumatic steel bar binding machine.
Figure 14:
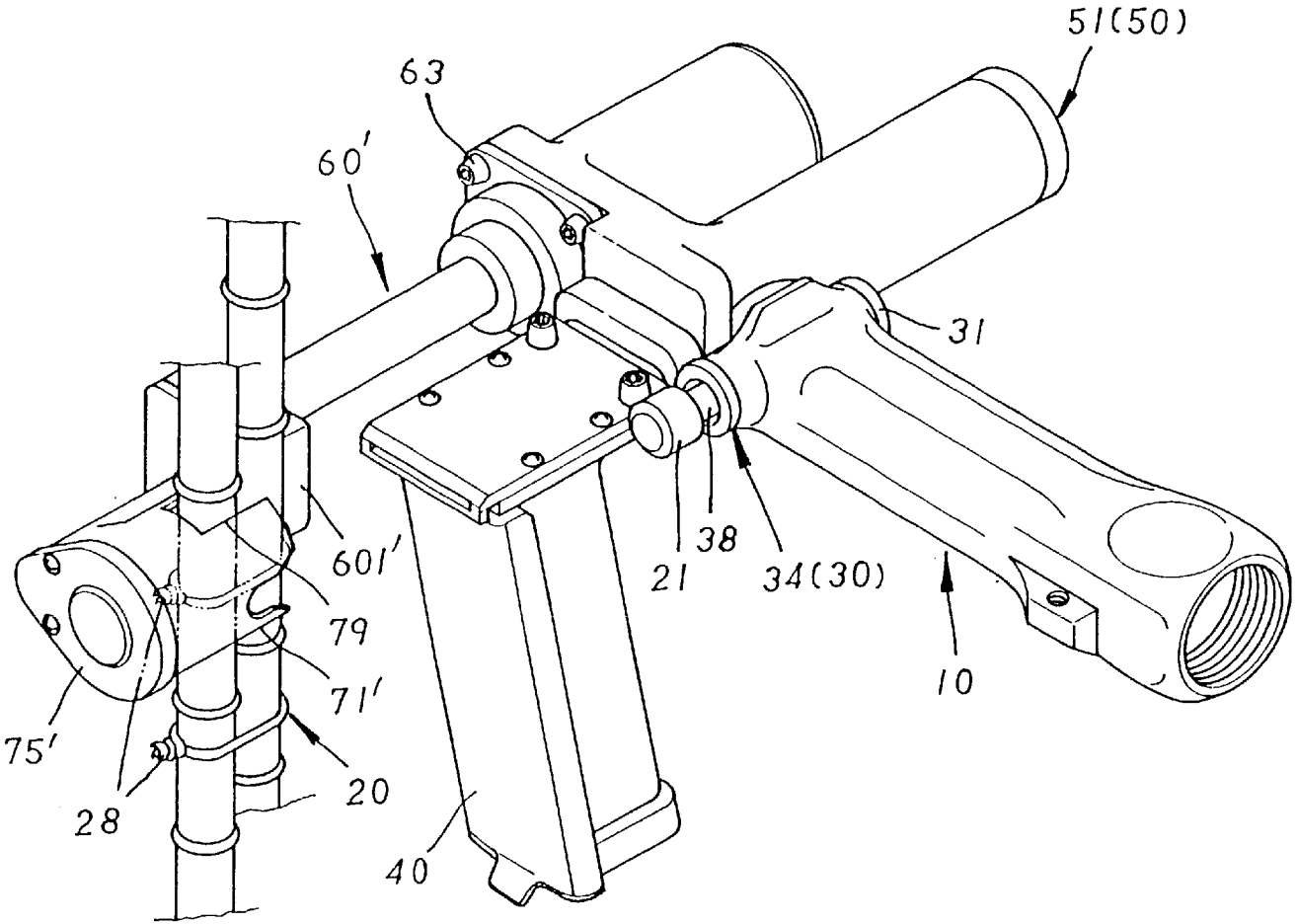
FIG. 14 illustrates another embodiment of the invention of pneumatic steel bar binding machine in the process of binding two thicker parallel steel bars.

In yet another embodiment of the invention described above, thicker parallel steel bars can be tied and bound. In the embodiment shown in FIGS. 13 and 14, the ramming mechanism 90 and the staple cartridge 40 are positioned at the front of the cylinder chamber 50 and assembled at 90 degrees to bind thicker parallel steel bars. Parts in the J-mechanism 60' include a transmission shaft 61', a spiral twister 80', a bearing 64', a small gear 65', an idler 68', a gear pin 681', a small hole large gear 73', a gear shaft 66', a small gear 69', and a support ring 71, wherein the top of the J-mechanism 60' is square, with four round holes drilled on the protrusion from the tips of four corners, which serve to tighten four screws, 63 that are joined to the pneumatic motor 70. At the center of the upper end is drilled a round hole with a larger upper section and a smaller lower section, penetrating to the square connecting block 601' at the bottom of its lower section, forming an accommodating hole 602', which serves to be inserted by the planetary gear set 55 and the transmission shaft 61'. At the upper and lower parts of the connecting block 601' is drilled a locking hole, at the lower part of the accommodating hole 602' is a positioning hole 603' to install the small hole large gear 73'. At the upper and lower ends of the transmission shaft 61 ' are bearings for positioning purpose. Its end section is machined as a square, at the end of the square is a screw thread to accommodate the small gear 65'. On the top of the support ring 71' is a square locking plate, on its upper and lower parts is drilled a round hole, which serves to tighten the two screws joining the connecting block 601'. At the center of the upper end is drilled a round hole penetrating to the bottom of the lower section, forming an accommodating hole 77', which is inserted by the small hole large gear 73' and t he gear shaft 66', with bearings at the upper and lower end so the gear shaft 66' for positioning purpose. Its end section is machined as a square, on the tail of the square is a screw thread to accommodate the small gear 69', whereby speed can be reduced by the small gear 65' in mesh with the idler 68', the idler 68' in mesh with the large gear 73', the large gear 73' driving the small gear 69', and the small gear 69' in mesh with the lower end of the spiral twister 80', so the spiral twister 80' will perform its twisting function and fasten the steel bars.

As described above, the novelty and practical production of the pneumatic steel bar binding machine will achieve the performance and efficiency anticipated in the invention. Therefore, this application is duly filed. Your favorable consideration will be appreciated.

What is claimed is:

1. A pneumatic steel bar binding apparatus comprising:

a J-shaped mechanism having a square panel with four corners at one end thereof, each of said four corners having a round hole formed therein, said square panel having a round hole formed centrally thereof, said round hole having a large diameter section and a small diameter section, said small diameter section having an accommodating hole in communication therewith and extending therefrom, said accommodating hole having a transmission shaft extending therethrough, said transmission shaft having a square end with a screw thread extending outwardly therefrom, said screw thread being affixed to a small diameter gear, said small diameter gear having teeth meshing with teeth of a large diameter gear, said large diameter gear being a compound gear with a small diameter gear element in axially aligned relation therewith, said small diameter gear element engaging another large gear such that a rotation of the said transmission shaft causes a rotation of said another large gear;

a spiral twister means having a toothed outer diameter in meshing relationship with said another large gear, said spiral twister means for twisting separate ends of a steel staple together when said transmission shaft causes said toothed outer diameter to rotate;

a support ring rotatably receiving said spiral twister means therein, said support ring positioned below said transmission shaft;

pneumatic drive means connected to said transmission shaft for rotating said transmission shaft upon actuation by an operator; and a ramming means cooperative with said spiral twister means for pushing the separate ends of said steel staple into said spiral twister means.

2. The apparatus of claim 1, said spiral twister means having a depressed hole in a center thereof, said depressed hole having a wide portion adjacent an end of said spiral twister means and a narrow portion inwardly therefrom, said depressed hole having a V-shaped cross-section, said V-shaped cross-section of said depressed hole having a pair of arched twisting blades therein, said pair of arched twisting blades defining a round hole therein, said round hole having a flattened post at a bottom thereof.

3. The apparatus of claim 1, said spiral twister means having a pair of arched depressed openings opposite to each other at an end surface adjacent an outside rim of said spiral twister means, a pair of arcs being respectively mounted between said pair of arched depressed openings at an inside rim of said spiral twister means.

4. The apparatus of claim 1, further comprising:

a staple cartridge means mounted in front of said spiral twister means, said staple cartridge means for delivering the steel staple to a position cooperative with said ramming means, said staple cartridge means and said ramming means being rotatable by 90° relative to said spiral twister means.

* * * * *